US005299629A

United States Patent [19]

Hyde

[11] Patent Number: 5,299,629

[45] Date of Patent: Apr. 5, 1994

[54] INTERLOCKING CHECKER BRICKS

[75] Inventor: Jack Hyde, Pittsburgh, Pa.

[73] Assignee: North American Refractories Company, Cleveland, Ohio

[21] Appl. No.: 899,873

[22] Filed: Jun. 12, 1992

[51] Int. Cl.[5] ..... F23D 17/02

[52] U.S. Cl. ..... 165/9.1; 165/9.4

[58] Field of Search ..... 165/9.1, 9.2, 9.3, 9.4

[56] References Cited

U.S. PATENT DOCUMENTS

| | | | |
|---|---|---|---|
| 490,726 | 1/1893 | Stevenson . | |
| 1,686,826 | 10/1928 | Loftus | 165/9.3 |
| 1,963,291 | 12/1933 | Brown, Jr. et al. . | |
| 2,017,763 | 10/1935 | Mamula et al. . | |
| 2,107,675 | 2/1938 | McKelvy | 165/9.1 |
| 3,134,584 | 5/1964 | Agnew | 165/9.1 |
| 3,777,805 | 12/1973 | Racasens et al. | 165/9.1 |
| 4,436,144 | 3/1984 | Horak . | |
| 4,479,777 | 10/1984 | Simon | 165/9.4 |
| 4,540,039 | 9/1985 | Karl . | |
| 4,651,810 | 3/1987 | Triessnig . | |
| 4,940,081 | 4/1990 | Hyde | 165/9.1 |

FOREIGN PATENT DOCUMENTS

| | | | |
|---|---|---|---|
| 2280046 | 2/1976 | France | 165/9.1 |
| 882696 | 11/1961 | United Kingdom | 165/9.3 |

OTHER PUBLICATIONS

Two-page excerpt from Harbison-Walker Refractories Company (more than one year old).

Didier Refractory Products Engineering Services brochure entitled, "Checker Systems Data, Conventional Batt (Semi-Closed) Flue Construction," (more than one year old).

Didier Refractory Products Engineering Services brochure entitled, "Checker Systems Data Alternate Conventional Open and Batt Flue Construction" (more than one year old).

Didier Refractory Products Engineering Services brochure entitled, "Checker Systems Data Conventional Flue Construction (Standard Setting)", (more than one year old).

Didier Refractory Products Engineering Services brochure entitled "Checker Systems Data Open Basket Wave Construction," (more than one year old).

"Experimental Studios of the Thermal Performance of Various Cruciform Regenerator Packings" written by Zanoli Begley and Vidil.

*Primary Examiner*—Albert W. Davis, Jr.

*Attorney, Agent, or Firm*—Watts, Hoffmann, Fisher & Heinke

[57] ABSTRACT

An interlocking checker brick used to form a checkerwork for use in recovering heat in thermal regenerators and recuperators. The checker brick is made of a refractory material and comprises a rectangular top, a rectangular base, two side walls and two end walls. The end walls have a trapezoidal shape and therefore each side wall forms an acute angle with respect to the base. This provides a brick that tapers in thickness from the base to the top and is trapezoidal in cross section. Checkerworks utilizing these bricks are arranged to improve the amount of exposed brick surface that acts as a thermal surface and to increase turbulence while reducing laminar flow during alternating cycles of flowing gases and air.

24 Claims, 4 Drawing Sheets

INTERLOCKING CHECKER BRICKS

TECHNICAL FIELD

The invention relates to refractory bricks and, more particularly, to interlocking checker bricks used for recovering heat in thermal regenerators or recuperators.

BACKGROUND OF THE INVENTION

Checker bricks are stacked atop one another to create checkerworks that are typically 18 feet high or higher and are contained in a regenerative or checker chamber. The checkerworks define flues for the alternating downward passage of burning gases within the chamber and upward passage of air within the chamber. The burning gases heat the bricks and the air absorbs heat from the bricks. During such passage, the bricks may tend to move. If the bricks do move relative to each other, the flues within the checkerwork can be partially blocked or even destroyed. It is therefore desirable to have the bricks remain in their original positions.

Prior bricks such as those presently used must be approximately 3 inches thick to stabilize the position of the bricks against displacement. With the prior bricks, approximately $\frac{3}{4}$–$\frac{7}{8}$ of an inch of the thickness from each exposed brick surface is involved in heat transfer during the alternating passages of the gases and air. The rest of the brick provides mass to provide stability. It is therefore desirable to reduce the mass of the brick as much as possible while maintaining stability thereby providing more exposed brick surface and flues per chamber.

SUMMARY OF THE INVENTION

Accordingly, it is an object of the present invention to provide checker bricks that maximize exposed surface area, minimize total refractory mass per unit of checker volume, and increase turbulence in gas flow and air flow within checkerworks.

Another object of the present invention is to provide checker bricks having the advantages of the previous paragraph and that are interfitting thereby allowing them to be used to construct stable checkerworks that are 18 feet high or higher and are resistant to displaced alignment.

A checker brick made in accordance with the present invention comprises a rectangular top, a rectangular base, two side walls and two end walls. The end walls have a trapezoidal shape and each side wall forms an acute angle with respect to the base. This provides a brick that tapers in thickness from the base to the top and is trapezoidal in cross section.

The brick is further characterized by one of either the top or base including at least two projections and the other of either said top or base including at least two recesses sized to mate with corresponding projections of like bricks. In one version of the brick, there are four projections and four recesses. The recesses and projections mate with projections and recesses of other bricks when bricks are stacked atop one another in an interlocking relationship. Preferably, the projections are frustums.

The tapered shape of the brick allows the bricks to have a thickness, i.e., the width of the brick measured by the width of the base or top, or the lateral dimension of the end walls, to be anywhere from 2–3 inches, or even less, and still be stacked in an interlocking relationship to form a stable checkerwork. The thickness of the bricks is dictated by the material used to make the bricks.

These bricks are used to form checkerworks that comprise tiers or layers of bricks. The bricks are interlocked with bricks of adjacent tiers by mating projections of bricks in one tier with recesses in bricks of a contiguous tier. The bricks of the checkerwork define flues for the passage of gases and air. In one embodiment of a checkerwork made with tiers of bricks having two projections and two recesses, the bricks are each positioned substantially perpendicular to two adjacent bricks within the same tier. Additionally, each brick is transverse to bricks located directly above and directly below it in adjacent tiers. At least a majority of the bricks are each spaced from all other bricks within their respective tiers.

In another embodiment of a checkerwork, tiers comprised of bricks having two projections and two recesses alternate with tiers comprised of rows of bricks having four projections and four recesses. In the tiers comprised of bricks having two projections and two recesses, at least a majority of the bricks are each spaced from all other bricks within the same tier. In the tiers comprised of bricks having four projections and four recesses, the bricks of each tier are aligned in spaced rows.

The advantages of the reduced thickness of the bricks and the checkerworks constructed with the bricks are numerous. The arrangement of the bricks, as well as their shape, in the checkerworks cause increased turbulence in the gas flow as well as the air flow thereby decreasing the laminar flow. This allows for better contact between the gas or air flow and the surfaces of the bricks.

Additionally, the arrangement of the bricks allows for increased brick surface exposure due to the shape and spacing of the bricks. The trapezoidal shape of the bricks allows the base of each brick to contribute to the amount of exposed brick surface that acts as a thermal surface. In the checkerworks wherein the bricks are spaced from all other bricks within their respective tiers, the bricks' end walls contribute to the amount of exposed brick surface that acts as a thermal surface.

Assuming that dimensions of each flue remain the same in checkerworks utilizing the bricks of this invention when compared to dimensions of the flues of prior checkerworks made with prior checker bricks, the refractory mass per unit volume decreases. This reduction in mass per unit volume results in a reduction of brick cost in an almost 1:1 relation. The exposed brick surface area per unit volume increases, thereby improving efficiency. The flow area (flue cross-sectional area per unit of regenerator cross-sectional area) increases. Because of this increase in efficiency, fuel consumption is significantly reduced.

DETAILED DESCRIPTION OF THE PREFERRED EMBODIMENT

Figure 1:
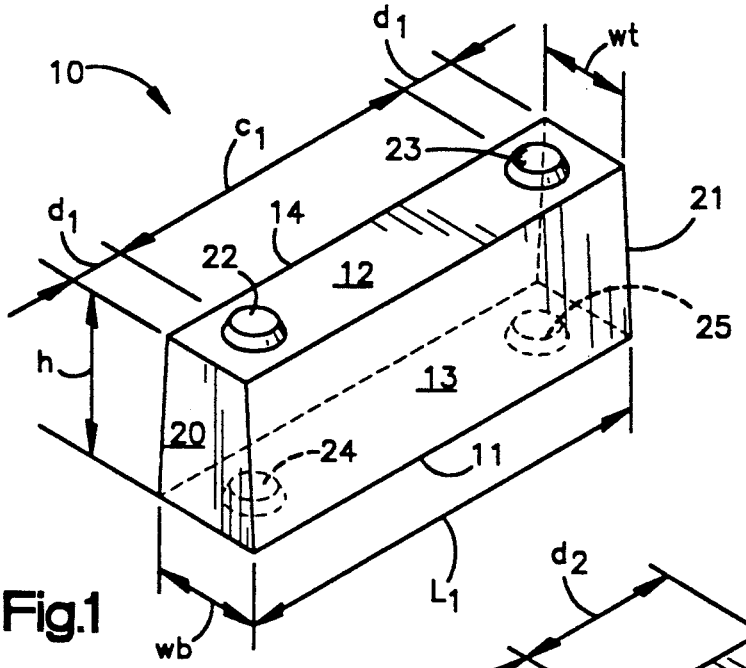
FIG. 1 is a perspective view of a brick according to one embodiment of the present invention.

FIG. 1 illustrates a brick 10 comprised of a refractory material and having a base 11 and a parallel top 12. The brick 10 further includes side walls 13, 14 that slant upwardly and inwardly from the base 11. The side walls 13, 14 parallel a longitudinal axis of the brick 10. The brick 10 also includes end walls 20, 21. The end walls 20, 21 parallel an axis that is transverse to the longitudinal axis of the brick 10.

The brick 10 has a lateral cross section that is trapezoidal in shape. Therefore, each end wall 20, 21 is trapezoidal in shape and each side wall 13, 14 forms an acute angle with respect to the base 11. Accordingly, the brick 10 tapers in width from the base 10 to the top 12.

In one embodiment, the top 12 has two mounting projections 22, 23. The mounting projections are preferably in the shape of frustums. The base 11 includes two recesses 24, 25 that correspond to the size, shape and position of the mounting projections 22, 23.

For illustrative purposes, the brick 10 illustrated in FIG. 1 has an overall length $L_1$ of 12 inches. The width wb of the base is 3 inches while the width wt of the top is 2½ inches. The height h of the brick is 4½ inches. The center to center distance $c_1$ between the mounting projections 22, 24 is 9 inches, while the distance $d_1$ measured from the center of each mounting projection to its corresponding nearest end wall is 1½ inches. It is therefore apparent that the center to center distance $c_1$ is six times the distance $d_1$.

Figure 2:
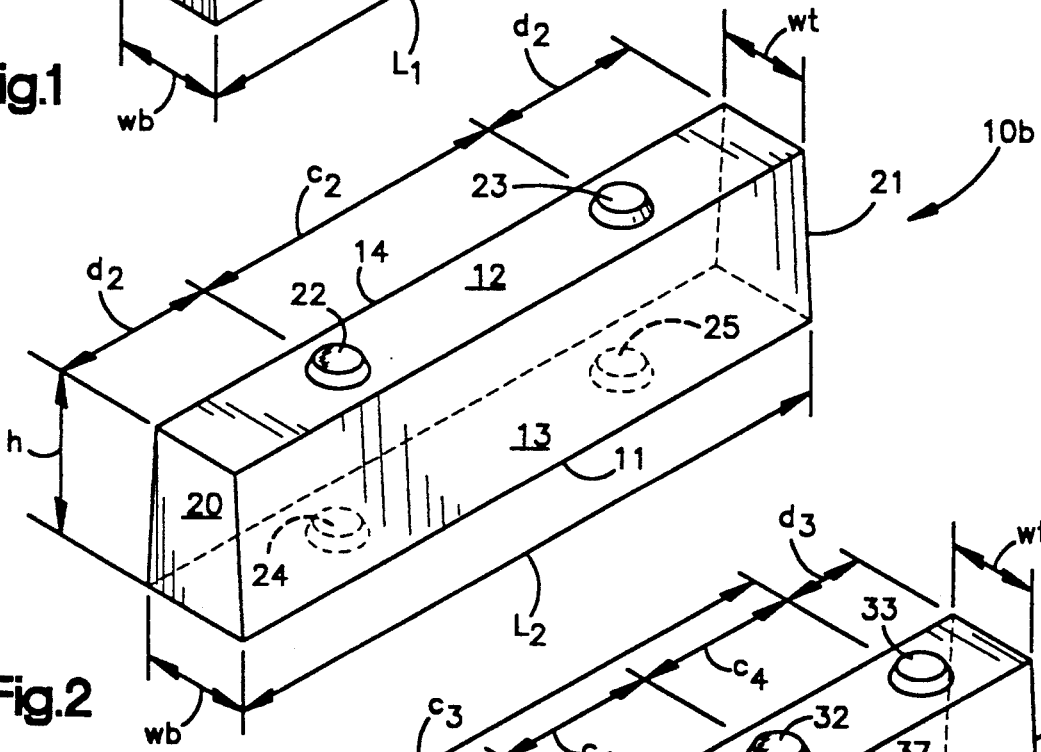
FIG. 2 is a perspective view of an another embodiment of a brick according to the present invention.

FIG. 2 illustrates a brick 10*a* that is similar in construction to the brick 10 illustrated in FIG. 1. The brick 10*a* has the same overall shape and features as the brick 10 illustrated in FIG. 1, but has a different overall length $L_2$. For illustrative purposes, the length $L_2$ of the brick 10*a* is 18 inches. The center to center distance between the mounting projections 22, 23 is still 9 inches, while the distance $d_2$ is equal to 4½ inches. Therefore, for brick 10*a*, the distance $c_2$ is twice the distance $d_2$. The other dimensions for the brick 10*a*, specifically wb, wt and h, are identical to the corresponding dimensions for the brick 10.

Figure 3:
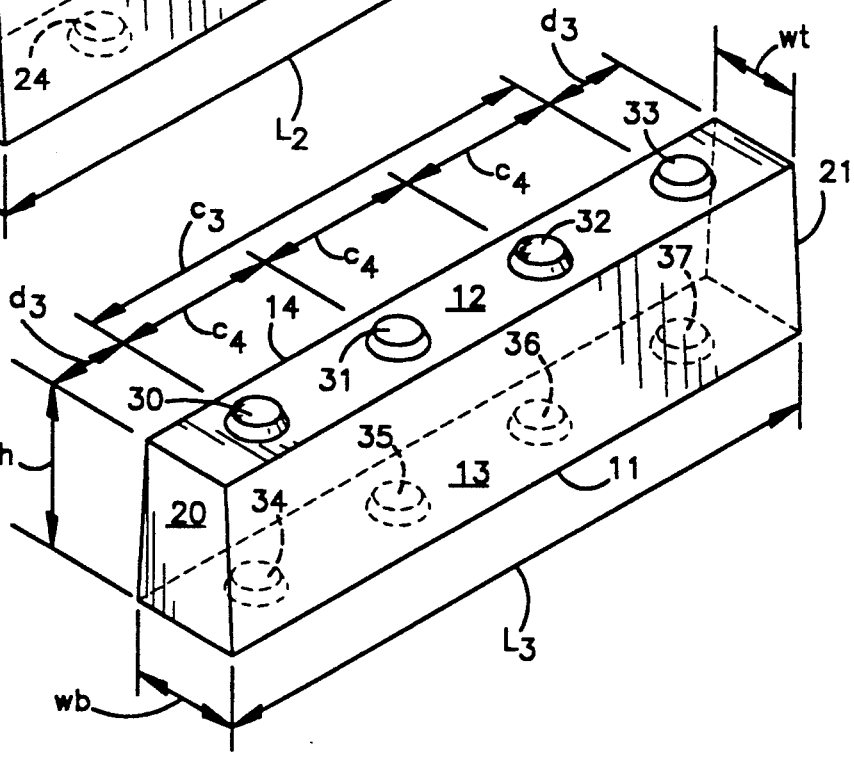
FIG. 3 is a perspective view of still another embodiment of a brick according to the present invention.

FIG. 3 illustrates a third brick 10*b*. The brick 10*b* has four mounting projections 30, 31, 32, 33. The brick 10*b* further includes four corresponding mounting recesses 34, 35, 36, 37. For illustrative purposes, the overall dimensions of the brick 10*b* are the same as the dimensions for the brick 10*a*. The center to center distance $c_4$ between two adjacent mounting projections is 4½ inches and the total center to center distance $c_3$ between the mounting projection 30 and the mounting projection 33 is 13½ inches. The distance $d_3$ from the center of either mounting projection 30 or 33 to its corresponding nearest end wall is 2¼ inches. Therefore, the total center to center distance $c_3$ is six times the distance $d_3$.

The dimensions of the bricks 10, 10*a*, 10*b* are dictated by the user, the material with which they are made, and the mode of transportation used to transport the bricks to their point of use. For all three bricks, the distances c and d of the mounting projections are applicable to corresponding dimensions for the recesses of each brick.

Figure 4:
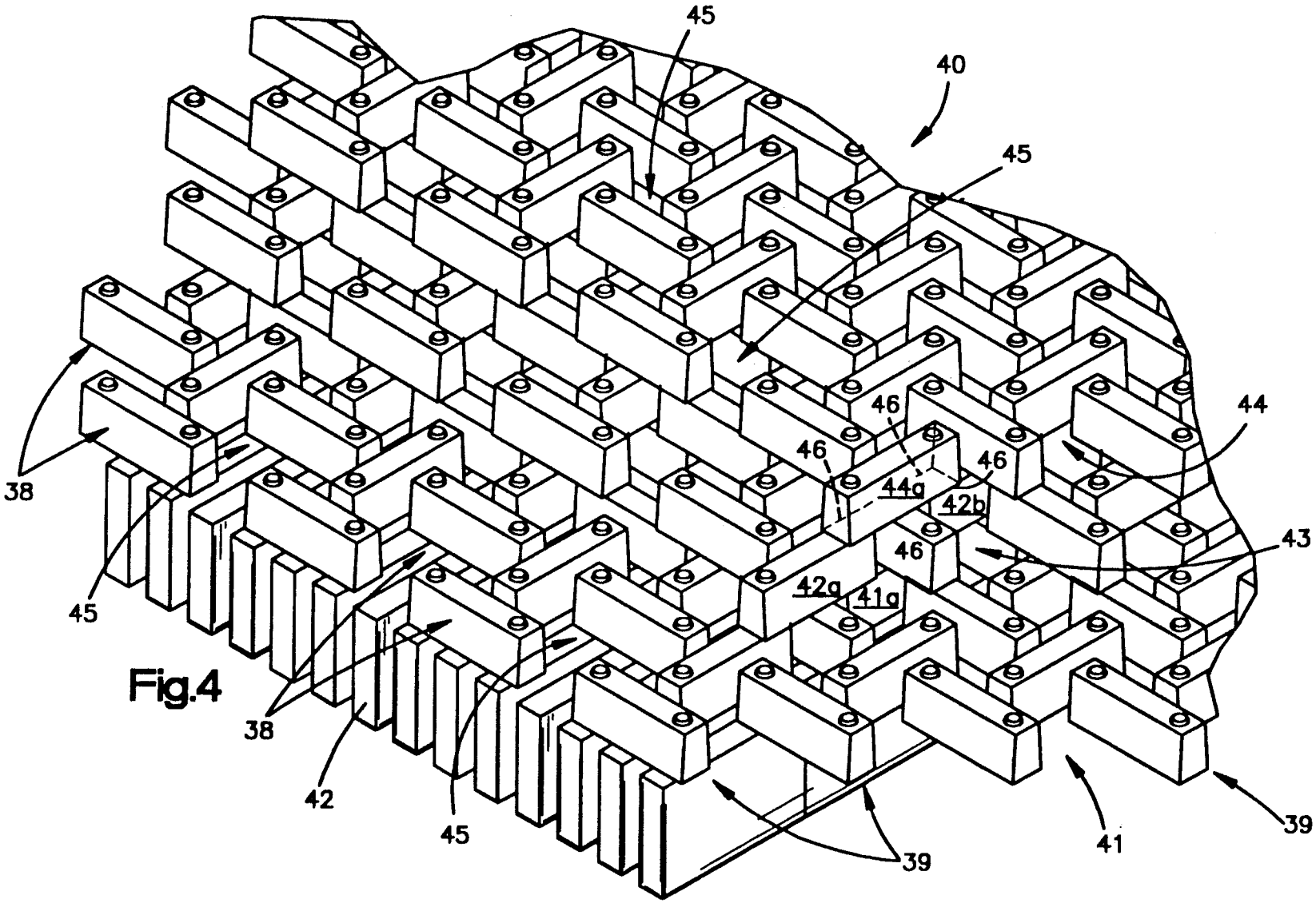
FIG. 4 is a fragmentary perspective view of a checkerwork utilizing checker bricks of FIG. 1.

FIG. 4 illustrates an embodiment of a checkerwork utilizing a plurality of bricks 10. The checkerwork 40 is made up of multiple tiers or layers of bricks 10 stacked in an interlocking relationship atop one another. A first tier 41 is placed on a grid 42. The bricks 10 of the first tier are spaced from each other such that no part of a brick is in contact with any other brick in that tier. Each brick is placed such that the brick is substantially perpendicular to adjacent bricks. Therefore, a series of rows 38 of bricks is orthogonal to and positioned between bricks in alternating rows of a second series of rows 39 of bricks.

A second tier 43 is arranged similarly to the first tier 41. Each brick of the second tier 43 interlocks with two bricks of the first tier 41 that are located about a vertical plane that contains all three bricks. This interlocking is accomplished by mating the recesses of the bricks in the second tier with the mounting projections of the bricks in the first tier. The bricks of the second tier are also atop and orthogonal to a first tier brick that extends between the two mated first tier bricks.

Subsequent tiers are then created by repeatedly mounting bricks 10 in the same fashion. As can be seen in FIG. 4, a brick 44*a* in a third tier 44 is located directly above its corresponding brick 41*a* in the first tier 41. The positioning of each of the bricks 10 creates a plurality of flues 45 through which heated gases and air travel.

Additionally, each brick aligned and stacked on other bricks in contiguous tiers located below them has a portion of its base surface 11 exposed. This is due to the tapered shape of the bricks and, in the FIG. 4 embodiment, the spacing of the bricks of each tier. For example, brick 44*a* is aligned and interlocked with bricks 42*a* and 42*b*. Because the base 11 of brick 44*a* is wider than the tops 12 of bricks 42*a* and 42*b*, a portion 46 of the base 11 is exposed. In addition, small transverse portions of the base of brick 44*a* are exposed to the spaces between the ends of the bricks 42*a* and 42*b* and the orthogonal brick between their ends.

Figure 5:
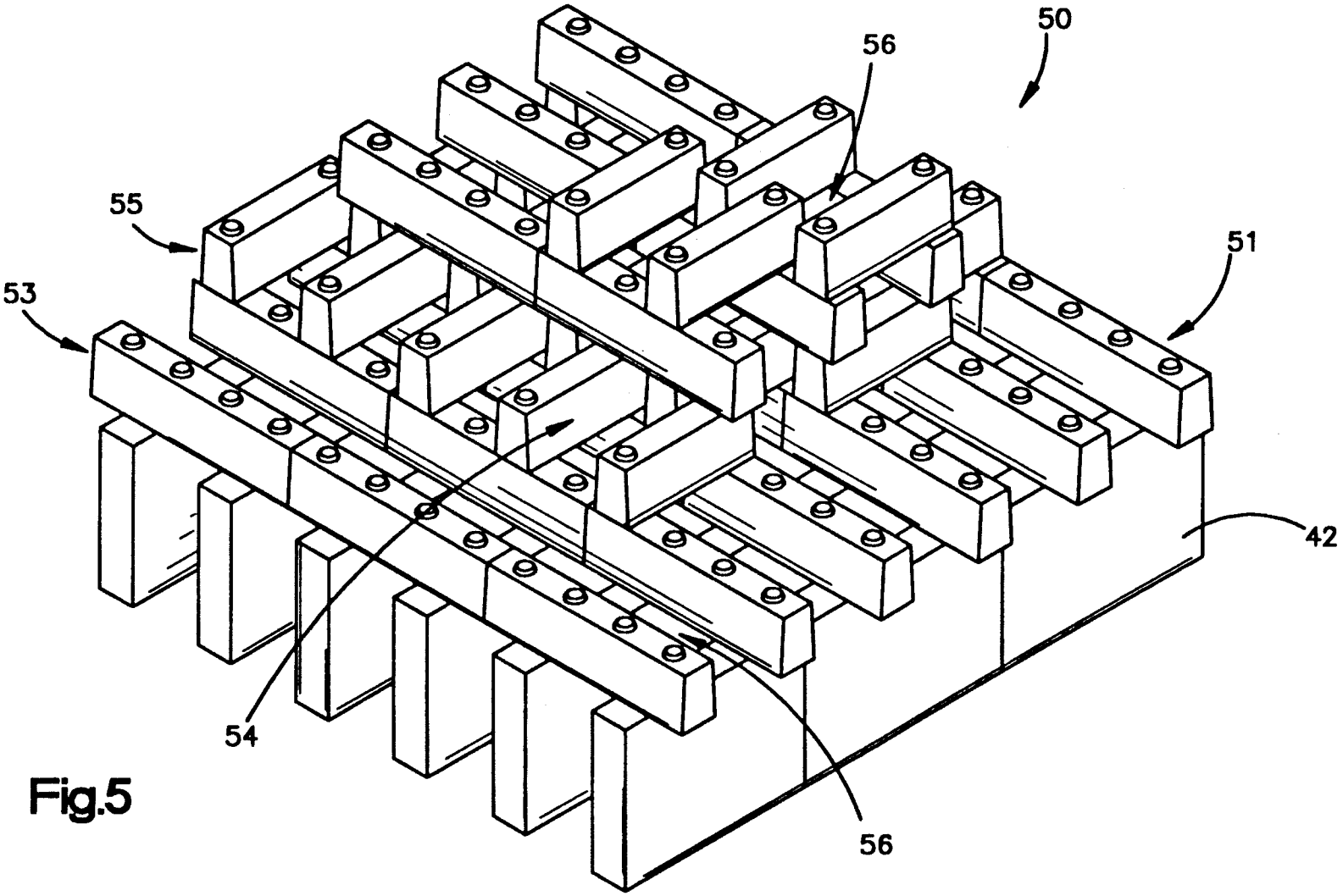
FIG. 5 is a fragmentary perspective view of another checkerwork utilizing checker bricks of FIGS. 1 and 3; and, FIG. 6 is a fragmentary perspective view of still another checkerwork utilizing checker bricks of FIG. 2.

FIG. 5 illustrates a second checkerwork that is comprised of alternating tiers of bricks wherein tiers of bricks 10*b* alternate with tiers of bricks 10. A first tier 51 is placed on a grid 52. The first tier 51 is comprised of parallel rows 53 of bricks 10*b*.

A second tier of bricks 54 is comprised of parallel rows 55 of bricks 10. The rows 55 are orthogonal to rows 53. Each brick 10 of the second tier 54 is mounted on and transverse to two bricks 10*b* of the first tier 51. Additionally, the bricks 10 of the second tier 54 are each spaced from all other bricks within the tier 54. Therefore, the bricks 10 of each row 55 within the second tier are staggered from each other. The checkerwork is completed by repeatedly forming alternating tiers in the described manner. The bricks within the checkerwork of FIG. 5 define flues 56 through which gases and air pass.

Figure 6:
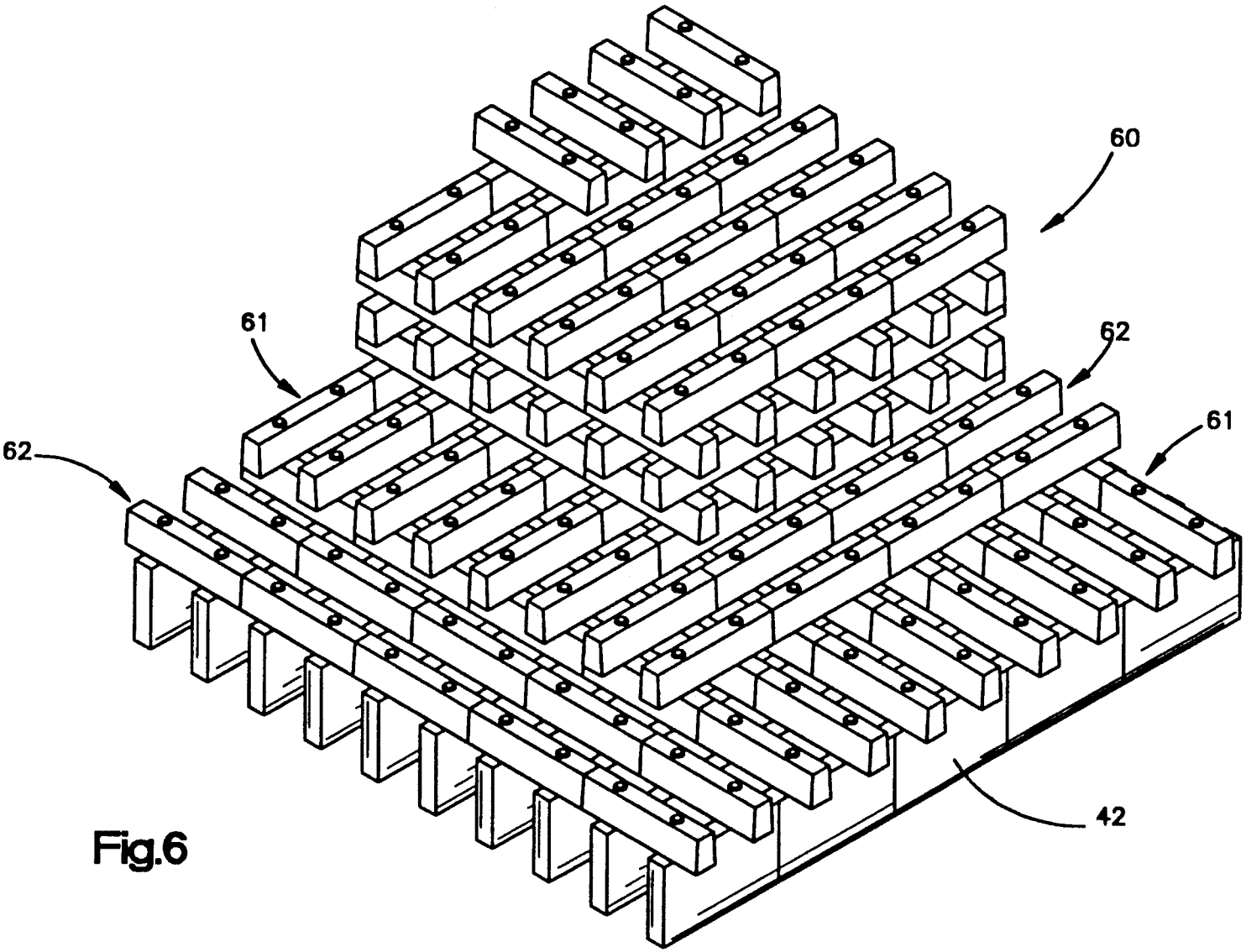

In a preferred embodiment, the checkerwork arrangement of FIG. 5 comprises approximately the upper fifteen percent of a total checkerwork while the remaining eighty-five percent of the total checkerwork is arranged as shown in FIG. 6.

FIG. 6 illustrates a checkerwork 60 comprised of tiers 61. The tiers 61 have rows 62 of bricks 10*b*. The bricks of each row are aligned end-to-end with each row 62 spaced from all others within its respective tier. Rows of each tier are transverse to rows of adjacent tiers.

The shape of the bricks and the spacing between the bricks provides more exposed brick area than prior bricks and checkerworks and thereby provides a more efficient heat transfer. In the checkerwork illustrated in FIG. 4, at least portions of all six surfaces of the bricks 10 are exposed. In the checkerwork illustrated in FIG. 5, in the tiers 54, at least a portion of all six surfaces of the bricks 10 is exposed. In the checkerworks illustrated in FIGS. 5 and 6, in the tiers 51 and 61, respectively, at least portions of four surfaces of the bricks 10*a* and 10*b* respectively, are exposed.

The arrangement of the bricks provides for more turbulence and a reduced laminar flow within the gas flow and the air flow. These advantages are provided for in large part by the trapezoidal shape of the bricks.

Because of the tapered design of the bricks, all embodiments of the checkerworks have overhanging lips that increase turbulence within the flues. Air or gas flowing along a brick in one tier will encounter the base of a brick in the same vertical plane, but different tier.

Although the preferred embodiment of this invention has been shown and described, it should be understood that various modifications and rearrangements of the bricks and checkerworks may be made without departing from the scope of the invention as disclosed and claimed herein.

I claim:

1. A checker brick comprising:

a. a substantially rectangular top surface;

b. a substantially rectangular base surface parallel to said top surface;

c. two side walls respectively spanning between and joining the surfaces;

d. two end walls each having a generally trapezoidal shape and extending between and joining the surfaces and the side walls;

e. one of the surfaces including at least two projections and the other of the surfaces including a like number of mounting recesses, said recesses and projections mating with projections and recesses of other bricks having like projections and recesses when multiple bricks are stacked atop one another in an interlocking relationship, the total longitudinal center-to-center distance between at least certain of projections and the recesses, respectively being at least equal to twice the distance from each projection and each recess to its nearest end wall; and, f. said walls and surfaces together defining the perimeter of the brick with the brick being substantially rectangular in longitudinal planes of cross-section and generally trapezoidal in transverse planes of cross-section.

2. The brick of claim 1 wherein the total longitudinal center-to-center distances between projections and between the recesses are respectively greater than twice the distances from each projection and each recess to its nearest end wall.

3. The brick of claim 1 wherein one of said surfaces includes at least four projections and the other of said surfaces includes at least four mounting recesses.

4. A checkerwork comprising tiers of stacked and interlocked bricks each of which is generally trapezoidal in transverse cross-section and generally rectangular in longitudinal cross-section, each brick including top and bottom surfaces, two side walls, two end walls, at least two interlock projections and at least two recesses that receive the interlock projections of at least two bricks in an adjacent tier; the bricks in each tier being orthogonal to at least one adjacent brick in an adjacent tier and being arranged in a pattern including a first series of parallel rows in which the bricks are in spaced end-to-end relation and a second series of rows which are orthogonal to and positioned between the bricks in alternating rows of the first series.

5. The checkerwork of claim 4 wherein bricks in alternating rows of the first series are staggered with respect to the bricks in adjacent rows.

6. The checkerwork of either of claims 5 wherein bricks in the first series of rows in a tier extend between and are interlocked with two bricks in the first series of rows in an underlying tier.

7. The checkerwork of claim 6 wherein bricks in the second series of rows in a tier extend between and are interlocked with two bricks in the second series of rows in an underlying tier.

8. The checkerwork of claim 6 wherein bricks in the second series of rows in a tier extend between and are interlocked with two bricks in the second series of rows in an underlying tier.

9. A checkerwork comprising tiers of stacked and interlocked bricks each of which is generally trapezoidal in transverse cross-section and rectangular in longitudinal cross-section, each brick including top and bottom surfaces, two side walls, two end walls, at least two projections and at least two recesses that receive like projections of at least two bricks in an adjacent tier; each tier being comprised of parallel rows of bricks; the rows of each tier being orthogonal to rows of adjacent tiers.

10. A checkerwork comprising:

a. a plurality of bricks arranged in layers stacked one atop the other;

b. each of the bricks substantially in the shape of a rectangular solid having top and bottom surfaces;

c. selected ones of the surfaces including outwardly extending projections each adapted to mate with a recess in a brick in a continuous layer;

d. the other of the surfaces of each brick including recesses each adapted to mate with a projection of a brick in the other contiguous layer;

e. the bricks of each layer being arranged in spaced rows with the rows of each layer being orthogonal to the rows of each continuous layer; and, f. the bricks of each row being longitudinally aligned.

11. The checkerwork of claim 10 wherein at least certain of the bricks are generally trapezoidal in cross-section.

12. The checkerwork of claim 10 wherein at least a majority of the bricks of at least some of the layers are each spaced from all other bricks of the same layer.

13. The checkerwork of claims 12 wherein said at least some of the layers are a majority of the layers.

14. The checkerwork of claim 10 wherein the brick projections and recesses are provided in pairs and wherein each brick has at least one pair of each.

15. A checkerwork structure comprising:

a. a plurality of layers of bricks stacked atop one another to form regenerative surfaces defining a series of flues for the vertical passage of gases alternatively to heat and to cool the bricks;

b. each of the bricks being six sided and including projections and recesses respectively cooperating with recesses and projections of bricks of contiguous layers; and, c. at least a majority of the bricks in certain of the layers being spaced from other bricks with four of its six sides in upright orientations and in contact with passing flue gases.

16. The checkerwork of claim 15 wherein said at least a majority of the bricks of said certain layers each having two of its six sides forming upper and lower surfaces and portions of said surfaces are in contact with passing flue gases.

17. The checkerwork of claim 15, wherein at least a majority of the bricks are trapezoidal in transverse cross-section.

18. A checkerwork comprising tiers of stacked and interlocked bricks each of which is trapezoidal in transverse cross-section and includes a top, a bottom, two side walls, two end walls, at least two projections and at least two recesses that receive the projections of at least two bricks in an adjacent tier; each tier being comprised of parallel rows of bricks; the rows of each tier being orthogonal to rows of adjacent tiers; certain of the tiers comprising bricks that have two projections and two recesses; and said certain tiers alternating with tiers comprising bricks that have four projections and four recesses.

19. The checkerwork of claim 18 wherein in each of the tiers comprising bricks that have two projections, each brick is spaced from all other bricks in the tier.

20. The checkerwork of claim 19 wherein in each of the tiers comprising bricks that have two projections, bricks in alternating rows are staggered with respect to the bricks in adjacent rows.

21. A checkerwork comprising tiers of stacked and interlocked bricks each of which is trapezoidal in transverse cross-section and includes a top, a bottom, two side walls, two end walls, at least two projections and at least two recesses that receive the projections of at least two bricks in an adjacent tier; each tier being comprised of parallel rows of bricks; the rows of each tier being orthogonal to rows of adjacent tiers; and certain said tiers in an upper portion of said checkerwork tiers comprising bricks that have two projections and two recesses alternating with tiers comprising bricks that have four projections and four recesses.

22. The checkerwork of claim 21 wherein tiers comprising bricks that have two projections and two recesses alternate with tiers comprising bricks that have four projections and four recesses.

23. The checkerwork of claim 22 wherein in each of the tiers comprising bricks that have two projections, each brick is spaced from all others bricks in the tier.

24. The checkerwork of claim 23 wherein in each of the tiers comprising bricks that have two projections, bricks in alternating rows are staggered with respect to the bricks in adjacent rows.

* * * * *